US010763573B2

(12) United States Patent
Liao et al.

(10) Patent No.: US 10,763,573 B2
(45) Date of Patent: Sep. 1, 2020

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Chih-Wei Liao, New Taipei (TW); Cheng-An Chen, New Taipei (TW); Jin-Bo Chen, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 6 days.

(21) Appl. No.: 16/261,976

(22) Filed: Jan. 30, 2019

(65) Prior Publication Data

US 2019/0252764 A1 Aug. 15, 2019

(30) Foreign Application Priority Data

Feb. 9, 2018 (CN) ..... 2018 1 0136694

(51) Int. Cl.

| | |
|---|---|
| ***H01Q 1/24*** | (2006.01) |
| ***H01Q 1/38*** | (2006.01) |
| ***H01Q 1/48*** | (2006.01) |
| ***H01Q 5/35*** | (2015.01) |

(52) U.S. Cl.

CPC ..... *H01Q 1/243* (2013.01); *H01Q 1/38* (2013.01); *H01Q 1/48* (2013.01); *H01Q 5/35* (2015.01)

(58) Field of Classification Search

CPC . H01C 1/243; H01C 9/42; H01C 1/22; H01C 5/28; H01C 1/44; H01Q 1/36; H01Q 5/35; H01Q 1/48; H01Q 1/38; H01Q 5/378; H01Q 21/28; H01Q 5/371; H01Q 5/328; H01Q 5/335; H01Q 1/242; H01Q 5/364; H01Q 5/307; H01Q 1/50

USPC ..... 434/848

See application file for complete search history.

(56) References Cited

U.S. PATENT DOCUMENTS

| | | | | |
|---|---|---|---|---|
| 9,413,058 | B1 * | 8/2016 | Kuo | H01Q 1/243 |
| 10,020,579 | B1 * | 7/2018 | Zheng | H01Q 1/24 |
| 10,063,100 | B2 * | 8/2018 | Singh | H01F 27/38 |
| 2017/0294952 | A1 * | 10/2017 | Uchida | H01Q 9/42 |

(Continued)

FOREIGN PATENT DOCUMENTS

| | | |
|---|---|---|
| CN | 105514604 A | 4/2016 |
| CN | 105514624 A | 4/2016 |
| CN | 205960191 U | 2/2017 |

*Primary Examiner* — Don P Le

(74) *Attorney, Agent, or Firm* — ScienBiziP, P.C.

(57) ABSTRACT

An antenna structure includes a side frame, a first feed portion, a second feed portion, and a first ground portion. The side frame defines a first gap and a second gap. The side frame is divided into a first radiating portion by the first gap and the second gap. When the first feed portion supplies current, the current flows through a first resonance section and is grounded through the first ground portion to activate a first operating mode and a second operating mode. When the first feed portion supplies current, the current flows through a second resonance section and is grounded through the second feed portion to activate a third operating mode. When the second feed portion supplies current, the current flows through the second resonance section and the first resonance section, and is grounded through the first ground portion to activate a fourth operating mode.

20 Claims, 9 Drawing Sheets

(56) References Cited

U.S. PATENT DOCUMENTS

2019/0181555 A1* 6/2019 Lee ..... H01Q 1/243
2019/0190150 A1* 6/2019 Tsou ..... H01Q 1/48

* cited by examiner

ANTENNA STRUCTURE AND WIRELESS COMMUNICATION DEVICE USING THE SAME

FIELD

The subject matter herein generally relates to an antenna structure and a wireless communication device using the antenna structure.

BACKGROUND

Antennas are important components in wireless communication devices for receiving and transmitting wireless signals at different frequencies, such as signals in Long Term Evolution Advanced (LTE-A) frequency bands. However, the antenna structure is complicated and occupies a large space in the wireless communication device, which is inconvenient for miniaturization of the wireless communication device.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
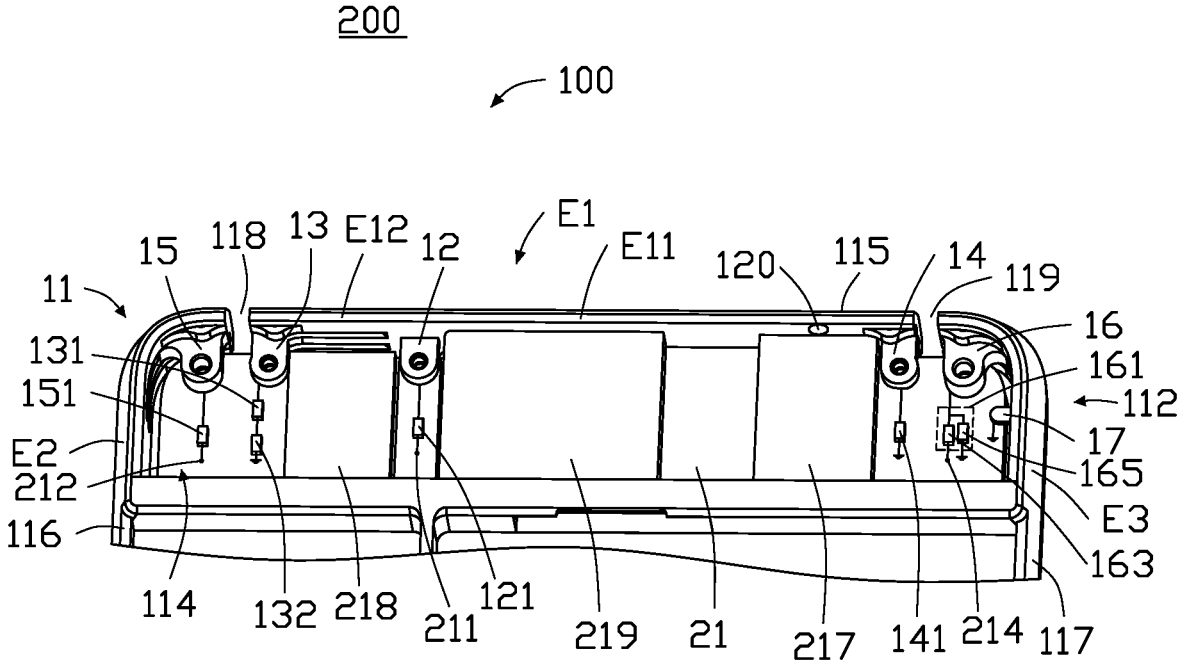
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an embodiment of a wireless communication device 200 using an antenna structure 100. The wireless communication device 200 can be, for example, a mobile phone or a personal digital assistant. The antenna structure 100 can receive and transmit wireless signals.

The wireless communication device 200 further includes a substrate 21. In this embodiment, the substrate 21 is made of dielectric material, for example, epoxy resin glass fiber (FR4) or the like. The substrate 21 includes a first feed point 211, a second feed point 212, and a third feed point 214. The first feed point 211, the second feed point 212, and the third feed point 214 are all positioned on the substrate 21 and are spaced apart from each other. The first feed point 211, the second feed point 212, and the third feed point 214 are configured to supply current to the antenna structure 100.

In this embodiment, the wireless communication device 200 further includes at least three electronic elements, for example, a first electronic element 217, a second electronic element 218, and a third electronic element 219. The first electronic element 217, the second electronic element 218, and the third electronic element 219 are positioned at one side of the substrate 21. The first electronic element 217, the second electronic element 218, and the third electronic element 219 are positioned between the second feed point 212 and the third feed point 214.

In this embodiment, the first electronic element 217 is an audio interface module. The first electronic element 217 is positioned between the first feed point 211 and the third feed point 214 adjacent to the third feed point 214. The second electronic element 218 is a front camera module. The second electronic element 218 is positioned between the first feed point 211 and the second feed point 212. The third electronic element 219 is a speaker. The third electronic element 219 is positioned between the first electronic element 217 and the second electronic element 218. The third electronic element 219 is positioned between the first feed point 211 and the third feed point 214 adjacent to the first feed point 211.

Figure 2:
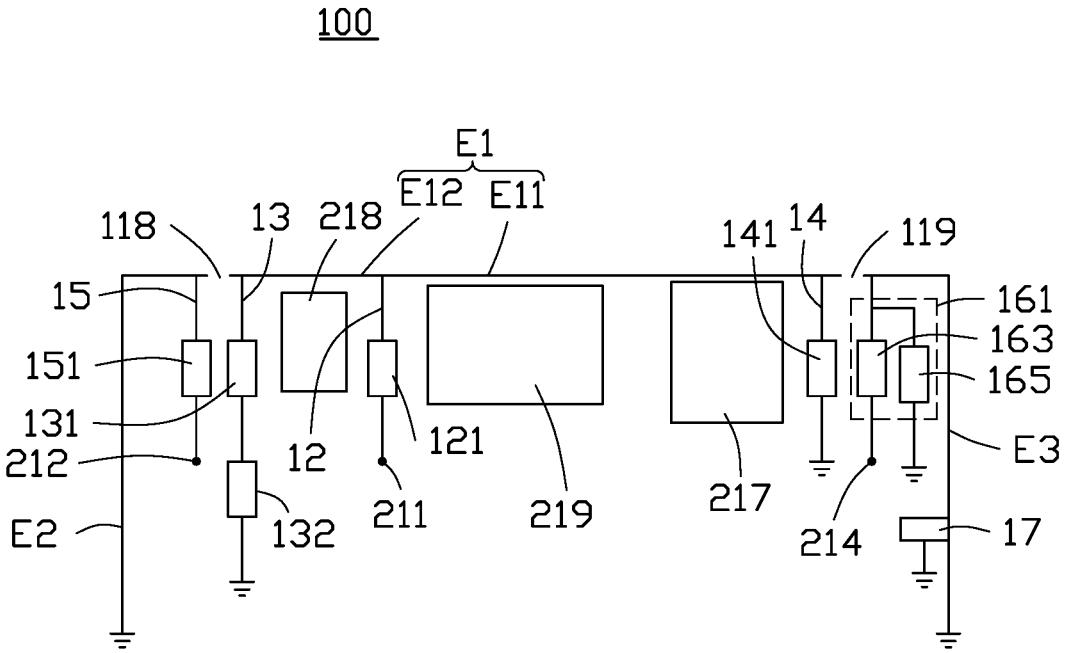
FIG. 2 is a circuit diagram of the antenna structure of FIG. 1.

In FIG. 2, the antenna structure 100 includes a housing 11, a first feed portion 12, a second feed portion 13, a first ground portion 14, a third feed portion 15, a fourth feed portion 16, and a second ground portion 17.

The housing 11 houses the wireless communication device 200. The housing 11 includes a side frame 112. In this embodiment, the side frame 112 is made of metallic material. The side frame 112 is substantially annular. The housing 11 further includes a backboard (not shown). The backboard is positioned on the side frame 112. The backboard and the side frame 112 cooperatively form a receiving space 114. The receiving space 114 can receive the substrate 21, a processing unit, or other electronic components or modules.

The side frame 112 includes an end portion 115, a first side portion 116, and a second side portion 117. In this embodiment, the end portion 115 is a top portion of the wireless communication device 200. The first side portion 116 is spaced apart from and parallel to the second side portion 117. The end portion 115 has first and second ends. The first side portion 116 is connected to the first end of the end portion 115 and the second side portion 117 is connected to the second end of the end portion 115.

The side frame 112 further defines a first gap 118 and a second gap 119. In this embodiment, the first gap 118 is defined in the end portion 115 adjacent to the first side portion 116. The second gap 119 is defined in the end portion 115 adjacent to the second side portion 117. The first gap 118 and the second gap 119 both pass through and extend to cut across the side frame 112. The side frame 112 is divided into three portions by the first gap 118 and the second gap 119. The three portions are a first radiating portion E1, a second radiating portion E2, and a third radiating portion E3. The first radiating portion E1, the second radiating portion E2, and the third radiating portion E3 are spaced apart from each other.

In this embodiment, a portion of the side frame 112 between the first gap 118 and the second gap 119 forms the first radiating portion E1. A portion of the side frame 112 extending from a side of the first gap 118 away from the first radiating portion E1 and the second gap 119 forms the second radiating portion E2. A portion of the side frame 112 extending from a side of the second gap 119 away from the first radiating portion E1 and the first gap 118 forms the third radiating portion E3. In this embodiment, the second radiating portion E2 and the third radiating portion E3 are both grounded.

In this embodiment, the first radiating portion E1 further defines a through hole 120. The through hole 120 passes through the first radiating portion E1 and corresponds to the first electronic element 217. Then, the first electronic element 217 is partially exposed from the through hole 120. An audio module (for example, an earphone) can be inserted into the through hole 120 and be electrically connected to the first electronic element 217.

In this embodiment, the first gap 118 and the second gap 119 are both filled with insulating material, for example, plastic, rubber, glass, wood, ceramic, or the like.

In this embodiment, the first feed portion 12 is positioned in the housing 11 between the second electronic element 218 and the third electronic element 219. One end of the first feed portion 12 is electrically connected to the first radiating portion E1. Another end of the first feed portion 12 is electrically connected to the first feed point 211 through a matching element 121 for feeding current to the first radiating portion E1.

In this embodiment, the matching element 121 is a 0 ohm resistor, that is, the matching element 121 is at a short-circuit state. In other embodiments, the matching element 121 may be other than the resistor. For example, the matching element 121 may be a capacitor, an inductor, or a combination.

In an embodiment, the first feed portion 12 further divides the first radiating portion E1 into a first resonance section E11 and a second resonance section E12. A portion of the side frame 112 between the first feed portion 12 and the second gap 119 forms the first resonance section E11. A portion of the side frame 112 between the first feed portion 12 and the first gap 118 forms the second resonance section E12. In one embodiment, the first feed portion 12 is not electrically connected to a middle position of the first radiating portion E1, the first resonance section E11 is longer than the second resonance section E12.

The second feed portion 13 is positioned in the housing 11 between the second electronic element 218 and the first side portion 116. One end of the second feed portion 13 is electrically connected to a near field communication (NFC) chip 132 through a matching element 131, and is grounded through the NFC chip 132. Another end of the second feed portion 13 is electrically connected to one end of the second resonance section E12 adjacent to the first gap 118.

In one embodiment, the matching element 131 is an inductor having an inductance of about 39 nH. In other embodiments, the matching element 131 may be other than the inductor. For example, the matching element 131 can be a capacitor, other matching elements, or a combination.

The first ground portion 14 is positioned in the housing 11 between the first electronic element 217 and the second side portion 117. One end of the first ground portion 14 is grounded through a ground element 141. Another end of the first ground portion 14 is electrically connected to an end of the first resonance section E11 adjacent to the second gap 119 for grounding the first radiating portion E1.

In one embodiment, the ground element 141 is an inductor having an inductance of about 5.6 nH. In other embodiments, the ground element 141 may be other than the inductor. For example, the ground element 141 can be a capacitor, other matching elements, or a combination.

The third feed portion 15 is positioned in the housing 11. One end of the third feed portion 15 is electrically connected to the second feed point 212 through a matching element 151. Another end of the third feed portion 15 is electrically connected to the second radiating portion E2 for supplying current to the second radiating portion E2.

In one embodiment, the matching element 151 is a capacitor having an capacitance of about 1.2 pF. In other embodiments, the matching element 151 may be other than the capacitor. For example, the matching element 151 can be an inductor, other matching elements, or a combination.

The fourth feed portion 16 is positioned in the housing 11. One end of the fourth feed portion 16 is electrically connected to one end of the third radiating portion E3 adjacent to the second gap 119. Another end of the fourth feed portion 16 is electrically connected to the third feed point 214 through a matching circuit 161 for supplying current to the third radiating portion E3.

In one embodiment, the matching circuit 161 includes a first matching unit 163 and a second matching unit 165. One end of the first matching unit 163 is electrically connected to the third feed point 214. Another end of the first matching unit 163 is electrically connected to the fourth feed portion 16 and one end of the second matching unit 165. Another end of the second matching unit 165 is grounded.

In one embodiment, the first matching unit 163 is a capacitor having a capacitance of about 0.8 pF. The second matching unit 165 is an inductor having an inductance of about 6.2 nH. In other embodiment, the first matching unit 163 and the second matching unit 165 may be other than the capacitor and the inductor. For example, the first matching unit 163 and the second matching unit 165 can be other matching elements or a combination.

The second ground portion 17 is positioned in the housing 11. The second ground portion 17 is spaced apart from the fourth feed portion 16. One end of the second ground portion 17 is electrically connected to the third radiating portion E3. Another end of the second ground portion 17 is grounded for grounding the third radiating portion E3.

Figure 3:
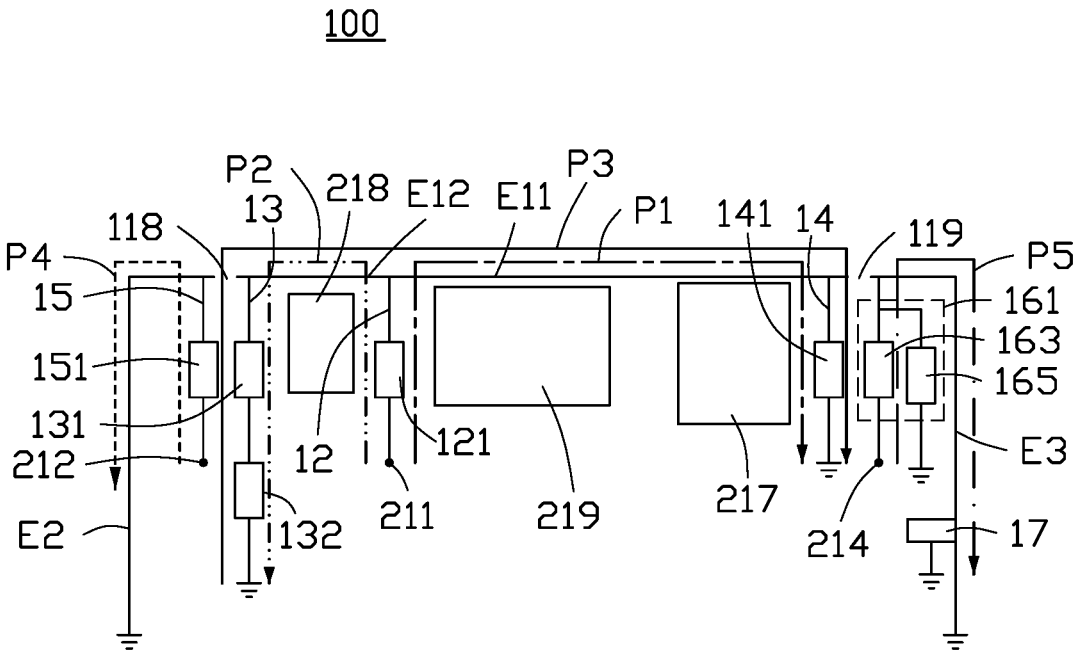
FIG. 3 is a current path distribution graph of the antenna structure of FIG. 2.

As illustrated in FIG. 3, when the first feed portion 12 supplies current, the current flows through the first resonance section E11 and the first ground portion 14, then is grounded through the ground element 141 (Per path P1). The first feed portion 12, the first resonance section E11, and the first ground portion 14 cooperatively form a loop antenna to activate a first operating mode and a second operating mode to generate radiation signals in a first radiation frequency band and a second radiation frequency band.

In addition, when the first feed portion 12 supplies current, the current flows through the second resonance section E12, the second feed portion 13, and the NFC chip 132, then is grounded through the NFC chip 132 (Per path P2). The first feed portion 12, the second resonance section E12, and the second feed portion 13 cooperatively form another loop antenna to activate a third operating mode to generate radiation signals in a third radiation frequency band.

When the second feed portion 13 supplies current, the current flows through the second resonance section E12, the first resonance section E11, and the first ground portion 14, then is grounded through the ground element 141 (Per path P3). The second feed portion 13, the first radiating portion E1, and the first ground portion 14 cooperatively form a loop antenna to activate a fourth operating mode to generate radiation signals in a fourth radiation frequency band.

When the third feed portion 15 supplies current, the current flows through the second radiating portion E2 through the third feed portion 15, and is grounded (Per path P4). The third feed portion 15 and the second radiating portion E2 cooperatively form a loop antenna to activate a fifth operating mode to generate radiation signals in a fifth radiation frequency band.

When the fourth feed portion 16 supplies current, the current flows through the third radiating portion E3 through the fourth feed portion 16, and is grounded through the second ground portion 17 (Per path P5). The fourth feed portion 16, the third radiating portion E3, and the second ground portion 17 cooperatively form a loop antenna to activate a sixth operating mode to generate radiation signals in a sixth radiation frequency band.

In this embodiment, the first operating mode is a Long Term Evolution Advanced (LTE-A) low frequency operating mode. The second operating mode and the third operating mode are both a LTE-A middle frequency operating mode. The fourth operating mode is a NFC operating mode. The fifth operating mode includes a global positioning system (GPS) operating mode, a WIFI 2.4/5 GHz operating mode, and a LTE-A high frequency operating mode. The sixth operating mode includes a WIFI 2.4/5 GHz operating mode.

In this embodiment, frequencies of the first radiation frequency band are about LTE-A 699-960 MHz. Frequencies of the second radiation frequency band is multiple of the frequencies of the first radiation frequency band. Frequencies of the second radiation frequency band and the third radiation frequency band are about 1805-2170 MHz. Frequencies of the fourth radiation frequency band are about 13.56 MHz. Frequencies of the fifth radiation frequency band include 1575-1605 MHz, 2412-2485 MHz, 5125-5825 MHz, and 2300-2690 MHz. Frequencies of the sixth radiation frequency band include 2412-2485 MHz and 5125-5825 MHz.

In this embodiment, the first feed portion 12, the second feed portion 13, the first radiating portion E1, and the first ground portion 14 cooperatively form a first antenna. The third feed portion 15 and the second radiating portion E2 form a second antenna. The fourth feed portion 16, the third radiating portion E3, and the second ground portion 17 cooperatively form a third antenna. The first antenna is a diversity antenna and a NFC antenna. The second antenna is a diversity antenna, a GPS antenna, and a WIFI 2.4/5 GHz antenna. The third antenna is a WIFI 2.4/5 GHz antenna.

In the first antenna, the first feed portion 12, the second feed portion 13, the first radiating portion E1, and the first ground portion 14 form the diversity antenna. The second feed portion 13, the first radiating portion E1, and the first ground portion 14 form the NFC antenna.

When the first antenna works at the third radiation frequency band, the first antenna is grounded through the second feed portion 13. When the first antenna works at the fourth radiation frequency band, the second feed portion 13 supplies current to the first antenna. That is, the second feed portion 13 can simultaneously serve as a ground of the diversity antenna and a signal feed point of the NFC antenna.

Figure 4:
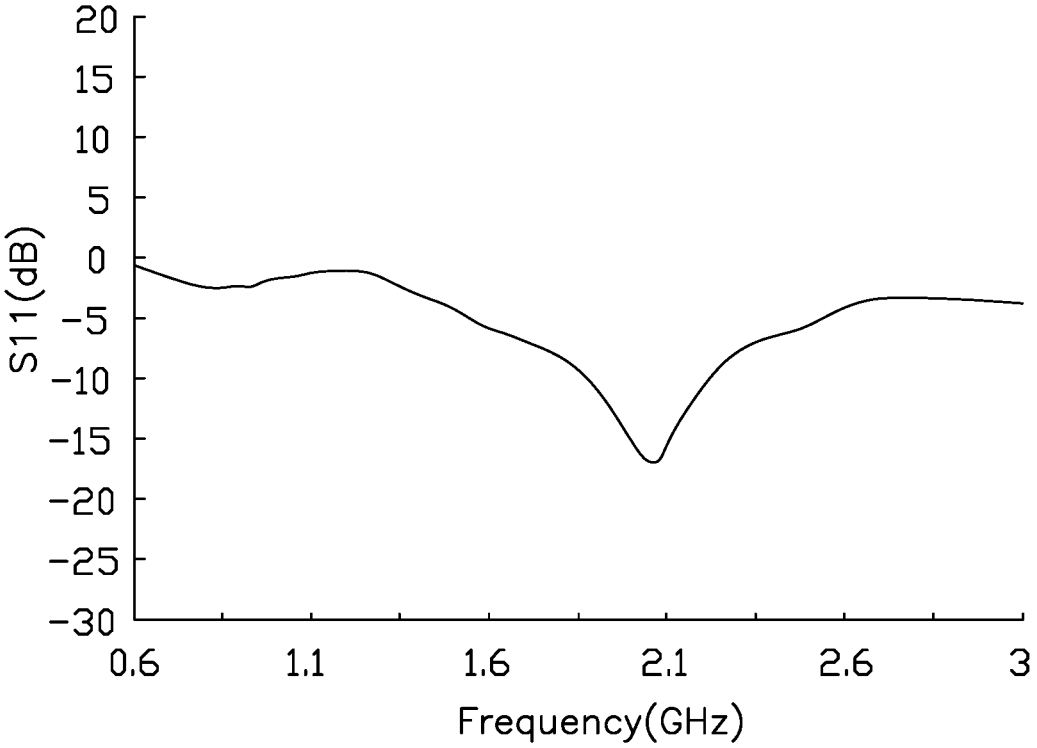
FIG. 4 is a scattering parameter graph of a first antenna of the antenna structure of FIG. 1.
Figure 5:
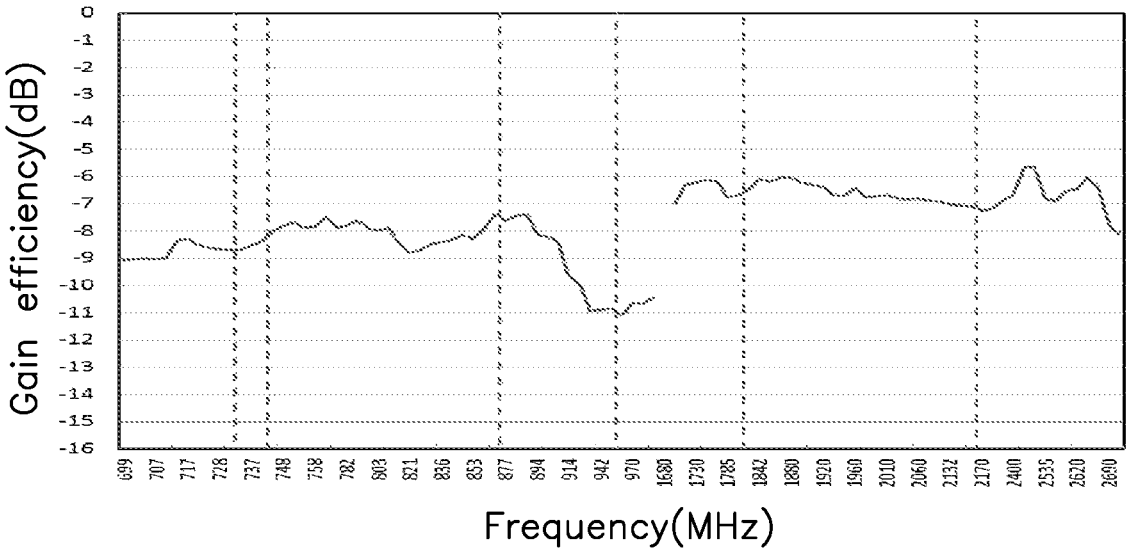
FIG. 5 is a gain efficiency graph of the first antenna of the antenna structure of FIG. 1.
Figure 6:
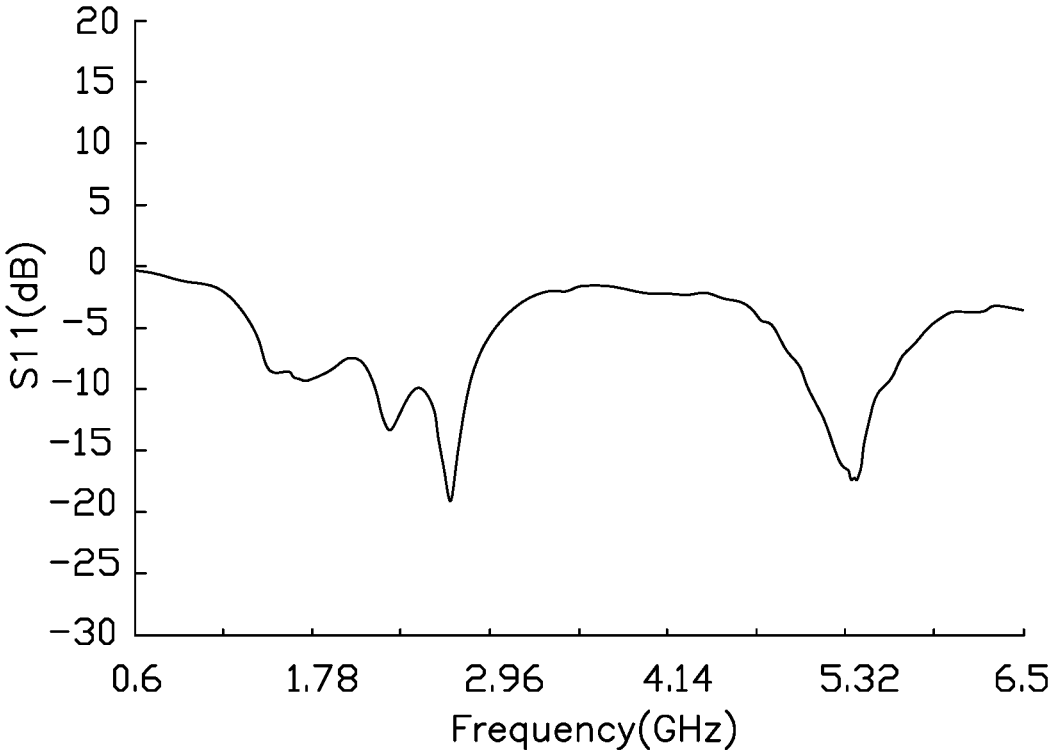
FIG. 6 is a scattering parameter graph of a second antenna of the antenna structure of FIG. 1.
Figure 7:
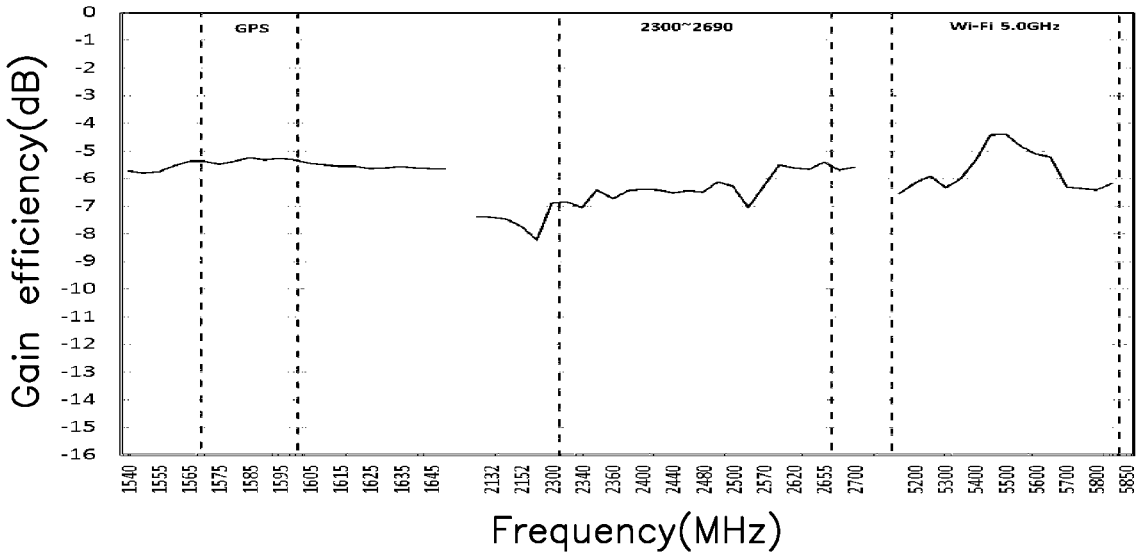
FIG. 7 is a gain efficiency graph of the second antenna of the antenna structure of FIG. 1.
Figure 8:
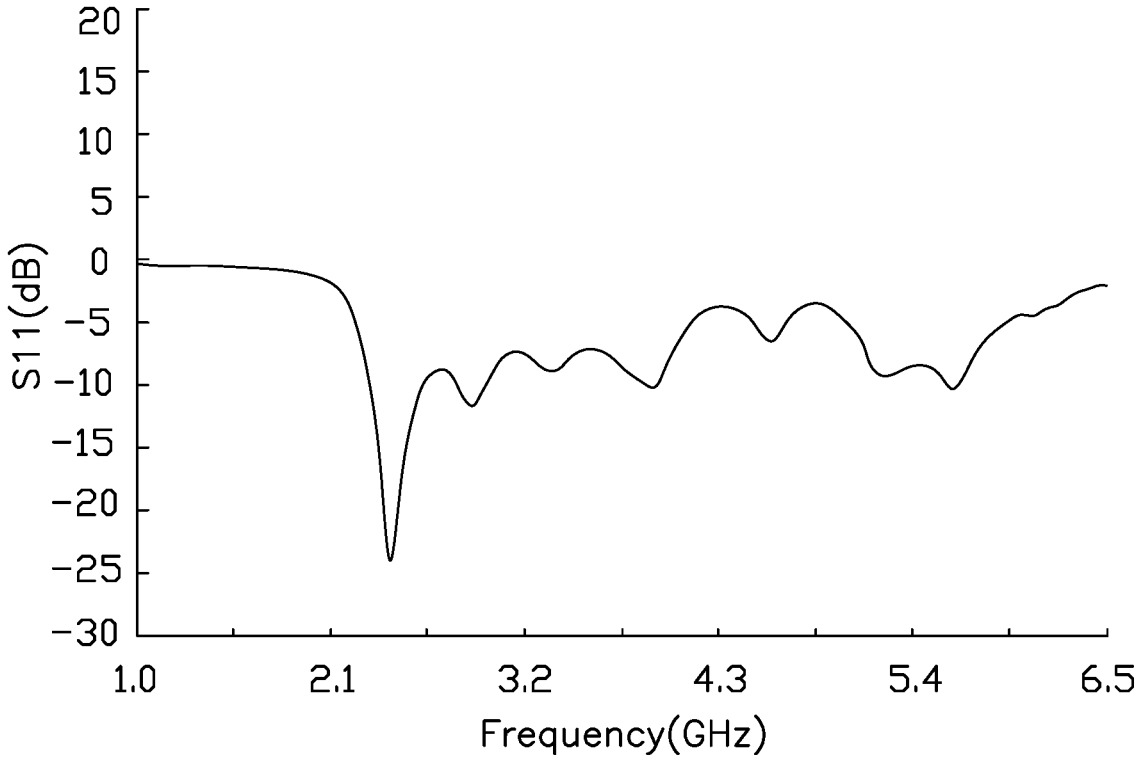
FIG. 8 is a scattering parameter graph of a third antenna of the antenna structure of FIG. 1.
Figure 9:
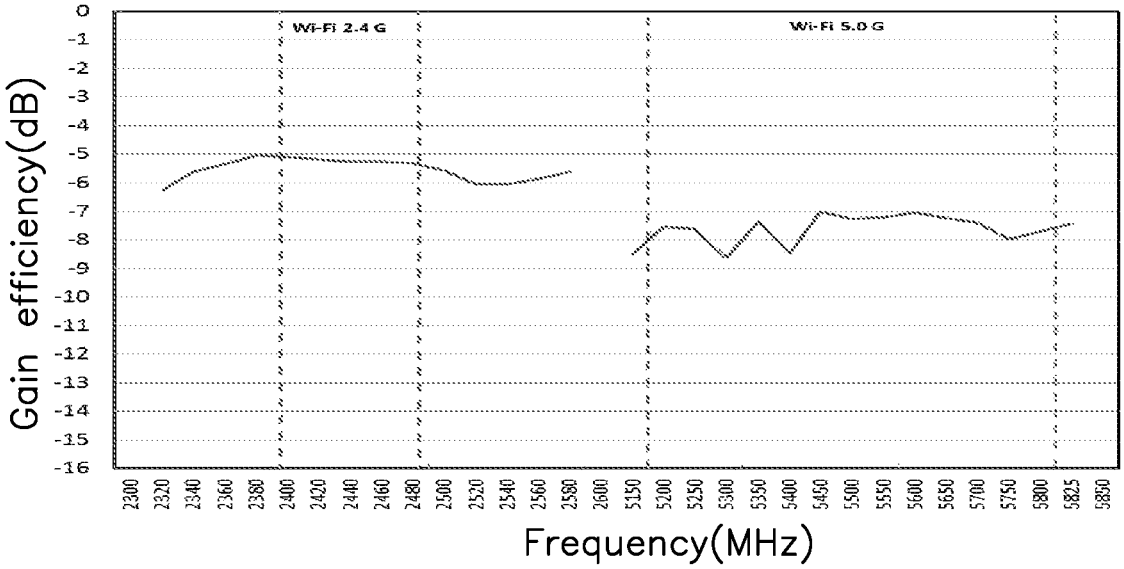
FIG. 9 is a gain efficiency graph of the third antenna of the antenna structure of FIG. 1.

FIG. 4 illustrates a scattering parameter graph of the first antenna of the antenna structure 100. FIG. 5 illustrates a gain efficiency graph of the first antenna of the antenna structure 100. FIG. 6 illustrates a scattering parameter graph of the second antenna of the antenna structure 100. FIG. 7 illustrates a gain efficiency graph of the second antenna of the antenna structure 100. FIG. 8 illustrates a scattering parameter graph of the third antenna of the antenna structure 100. FIG. 9 illustrates a gain efficiency graph of the third antenna of the antenna structure 100.

In views of FIG. 4 to FIG. 9, a working frequency of the antenna structure 100 can cover 699-960 MHz, 1710-2690 MHz, 1575-1605 MHz, and 5125-5825 MHz. That is, the antenna structure 100 may work at corresponding LTE-A low, middle, and high frequency bands, frequency bands of GPS, NFC, and WIFI 2.4/5 GHz. When the antenna structure 100 works at these frequency bands, the antenna structure 100 has a good radiating efficiency, which satisfies antenna design requirements.

As described above, the antenna structure 100 defines the first gap 118 and the second gap 119, then the side frame 112 is divided into a first radiating portion E1 and a second radiating portion E2. The antenna structure 100 further includes the first feed portion 12, the second feed portion 13, the first ground portion 14, and the third feed portion 15. The current from the first feed portion 12 flows through the first resonance section E11 of the first radiating portion E1 and is further grounded through the first ground portion 14 to activate the first operating mode to generate radiation signals in the LTE-A low frequency band and the second operating mode to generate radiation signals in a first LTE-A middle frequency band.

The current of the first feed portion 12 further flows through the second resonance section E12 of the first radiating portion E1, and is grounded through the second feed portion 13 to activate the third operating mode to generate radiation signals in a second LTE-A middle frequency band. The current of the third feed portion 15 flows through the second radiating portion E2, and the second radiating portion E2 generates radiation signals in the LTE-A high frequency band. That is, the wireless communication device 200 can use carrier aggregation (CA) technology of LTE-A to receive or send wireless signals at multiple frequency bands simultaneously.

In addition, in this embodiment, the second antenna and the third antenna can generate or receive radiation signals of WIFI 2.4/5 GHz, the antenna structure 100 can realize WIFI Multi-input Multi-output (MIMO) function. That is, the antenna structure 100 can fully meet receiving and transmitting functions of LTE/GSM/UMTS, GPS 1575 MHz, Wi-Fi MIMO 2.4/5 GHz, NFC 13.56 MHz bands, required for 4G LTE handsets, which includes reception and transmission functions of frequency bands of 700/850/900/1800/

1900/2100/2300/2500 MHz, GPS 1575 MHz, Wi-Fi 2.4/5 GHz, and NFC 13.56 MHz, and also has a 3CA function and a Wi-Fi MIMO function.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a side frame, the side frame defining a first gap and a second gap, the first gap and the second gap both passing through and extending to cut across the side frame, wherein the side frame is divided into a first radiating portion by the first gap and the second gap;

a first feed portion, the first feed portion electrically connected to the first radiating portion for dividing the first radiating portion into a first resonance section and a second resonance section;

a second feed portion, the second feed portion electrically connected to one end of the second resonance section adjacent to the first gap; and a first ground portion, the first ground portion electrically connected to one end of the first resonance section adjacent to the second gap;

wherein when the first feed portion supplies current, the current flows through the first resonance section and is grounded through the first ground portion to activate a first operating mode and a second operating mode to generate radiation signals in a first radiation frequency band and a second radiation frequency band;

wherein when the first feed portion supplies current, the current flows through the second resonance section and is grounded through the second feed portion to activate a third operating mode to generate radiation signals in a third radiation frequency band; and wherein when the second feed portion supplies current, the current flows through the second resonance section and the first resonance section, and is grounded through the first ground portion to activate a fourth operating mode to generate radiation signals in a fourth radiation frequency band.

2. The antenna structure of claim 1, wherein the first operating mode is a LTE-A low frequency operating mode, the second operating mode and the third operating mode are a LTE-A middle frequency operating mode, and the fourth operating mode is a near field communication (NFC) operating mode.

3. The antenna structure of claim 2, further comprising a NFC chip, wherein one end of the second feed portion is electrically connected to the second resonance section, another end of the second feed portion is electrically connected to the NFC chip and is grounded through the NFC chip, then the antenna structure works at the NFC operating mode.

4. The antenna structure of claim 1, wherein the side frame comprises an end portion, a first side portion, and a second side portion, the first side portion and the second side portion are respectively connected to two ends of the end portion; wherein the first gap and the second gap are both defined in the end portion, and a portion of the side frame between the first gap and the second gap forms the first radiating portion.

5. The antenna structure of claim 4, further comprising a third feed portion, wherein a portion of the side frame extending from a side of the first gap away from the first radiating portion and the second gap forms a second radiating portion, the second radiating portion is grounded; wherein one end of the third feed portion is electrically connected to one end of the second radiating portion adjacent to the first gap for supplying current to the second radiating portion, and wherein the second radiating portion activates a fifth operating mode to generate radiation signals in a fifth radiation frequency band.

6. The antenna structure of claim 5, wherein the fifth operating mode comprises a GPS operating mode, a WIFI 2.4/5 GHz operating mode, and a LTE-A high frequency operating mode.

7. The antenna structure of claim 5, further comprising a fourth feed portion and a second ground portion, wherein a portion of the side frame extending from a side of the second gap away from the first radiating portion and the first gap forms a third radiating portion, the third radiating portion is grounded; wherein the fourth feed portion is electrically connected to one end of the third radiating portion adjacent to the second gap, and the second ground portion is electrically connected to the third radiating portion; wherein when the fourth feed portion supplies current, the third radiating portion activates a sixth operating mode to generate radiation signals in a sixth radiation frequency band.

8. The antenna structure of claim 7, wherein the sixth operating mode comprises a WIFI 2.4/5 GHz operating mode.

9. The antenna structure of claim 1, wherein the first gap and the second gap are both filled with insulating material.

10. The antenna structure of claim 5, wherein a wireless communication device uses the first radiating portion and the second radiating portion to receive or send wireless signals at multiple frequency bands simultaneously through carrier aggregation (CA) technology of Long Term Evolution Advanced (LTE-A).

11. The antenna structure of claim 7, wherein a wireless communication device uses the second radiating portion and the third radiating portion to realize a WIFI MIMO function.

12. A wireless communication device comprising:

an antenna structure, the antenna structure comprising:

a side frame, the side frame defining a first gap and a second gap, the first gap and the second gap both passing through and extending to cut across the side frame, wherein the side frame is divided into a first radiating portion by the first gap and the second gap;

a first feed portion, the first feed portion electrically connected to the first radiating portion for dividing the first radiating portion into a first resonance section and a second resonance section;

a second feed portion, the second feed portion electrically connected to one end of the second resonance section adjacent to the first gap; and a first ground portion, the first ground portion electrically connected to one end of the first resonance section adjacent to the second gap;

wherein when the first feed portion supplies current, the current flows through the first resonance section and is grounded through the first ground portion to activate a first operating mode and a second operating mode to generate radiation signals in a first radiation frequency band and a second radiation frequency band;

wherein when the first feed portion supplies current, the current flows through the second resonance section and is grounded through the second feed portion to activate a third operating mode to generate radiation signals in a third radiation frequency band; and wherein when the second feed portion supplies current, the current flows through the second resonance section and the first resonance section, and is grounded through the first ground portion to activate a fourth operating mode to generate radiation signals in a fourth radiation frequency band.

13. The wireless communication device of claim 12, wherein the first operating mode is a LTE-A low frequency operating mode, the second operating mode and the third operating mode are a LTE-A middle frequency operating mode, and the fourth operating mode is a near field communication (NFC) operating mode.

14. The wireless communication device of claim 13, wherein the antenna structure further comprises a NFC chip, one end of the second feed portion is electrically connected to the second resonance section, another end of the second feed portion is electrically connected to the NFC chip and is grounded through the NFC chip, then the antenna structure works at the NFC operating mode.

15. The wireless communication device of claim 12, wherein the side frame comprises an end portion, a first side portion, and a second side portion, the first side portion and the second side portion are respectively connected to two ends of the end portion; wherein the first gap and the second gap are both defined in the end portion, and a portion of the side frame between the first gap and the second gap forms the first radiating portion.

16. The wireless communication device of claim 14, wherein the antenna structure further comprises a third feed portion, a portion of the side frame extending from a side of the first gap away from the first radiating portion and the second gap forms a second radiating portion, the second radiating portion is grounded; wherein one end of the third feed portion is electrically connected to one end of the second radiating portion adjacent to the first gap for supplying current to the second radiating portion, and wherein the second radiating portion activates a fifth operating mode to generate radiation signals in a fifth radiation frequency band.

17. The wireless communication device of claim 16, wherein the fifth operating mode comprises a GPS operating mode, a WIFI 2.4/5 GHz operating mode, and a LTE-A high frequency operating mode.

18. The wireless communication device of claim 16, wherein the antenna structure further comprises a fourth feed portion and a second ground portion, a portion of the side frame extending from a side of the second gap away from the first radiating portion and the first gap forms a third radiating portion, the third radiating portion is grounded; wherein the fourth feed portion is electrically connected to one end of the third radiating portion adjacent to the second gap, and the second ground portion is electrically connected to the third radiating portion; wherein when the fourth feed portion supplies current, the third radiating portion activates a sixth operating mode to generate radiation signals in a sixth radiation frequency band.

19. The wireless communication device of claim 16, wherein the wireless communication device uses the first radiating portion and the second radiating portion to receive or send wireless signals at multiple frequency bands simultaneously through carrier aggregation (CA) technology of Long Term Evolution Advanced (LTE-A).

20. The wireless communication device of claim 18, wherein the wireless communication device uses the second radiating portion and the third radiating portion to realize a WIFI MIMO function.

* * * * *